US005083419A

United States Patent [19]

Greifeneder et al.

[11] Patent Number: 5,083,419

[45] Date of Patent: Jan. 28, 1992

[54] METHOD OF PRODUCING A YARN AND AN APPARATUS FOR CARRYING OUT THIS METHOD

[75] Inventors: Karl Greifeneder, Heilbronn; Kurt Truckenmuller, Flein, both of Fed. Rep. of Germany

[73] Assignee: Amann Und Sohne GmbH & Co., Fed. Rep. of Germany

[21] Appl. No.: 453,067

[22] Filed: Dec. 11, 1989

Related U.S. Application Data

[63] Continuation of Ser. No. 206,528, Jun. 14, 1988, abandoned.

[30] Foreign Application Priority Data

Jun. 15, 1987 [DE] Fed. Rep. of Germany ..... 3720237

[51] Int. Cl.[5] ..... D02G 3/38; D02J 1/22

[52] U.S. Cl. ..... 57/6; 28/245; 57/288; 57/310; 264/290.7

[58] Field of Search ..... 57/3, 6, 287, 288, 310; 28/220, 254, 271-276

[56] References Cited

U.S. PATENT DOCUMENTS

| | | | |
|---|---|---|---|
| 2,855,749 | 10/1958 | Eshuis | 57/310 X |
| 2,942,325 | 6/1960 | Spellman | 264/290.7 X |
| 3,114,999 | 12/1963 | Coggeshall | 57/310 |
| 3,115,744 | 12/1963 | Nott | 57/310 |
| 3,379,809 | 4/1968 | Woods | 264/290.7 X |
| 3,558,767 | 1/1971 | Gopez | 264/290.7 |
| 3,665,696 | 5/1972 | Gubinsky | 57/310 |
| 3,724,199 | 4/1973 | Armstrong | 57/310 |
| 3,762,147 | 10/1973 | Wuest | 57/310 |
| 4,341,068 | 7/1982 | Negishi et al. | 57/310 X |
| 4,497,099 | 2/1985 | Scott | 57/6 X |
| 4,523,426 | 6/1985 | Scott et al. | 57/247 |
| 4,615,167 | 10/1986 | Greenberg | 57/6 |

*Primary Examiner*—Joseph J. Hail, III

*Attorney, Agent, or Firm*—Andrus, Sceales, Starke & Sawall

[57] ABSTRACT

In a method and apparatus for producing a yarn, a synthetic pre-oriented multifilament yarn is fed at a first velocity to a non-heated pin having a diameter less than 10 mm. After turning the yarn around the pin for an angle between 270° and 360°, the yarn is heated to a temperature between 100° C. and 250° C. for between 0.01 sec and 10 sec. The yarn is then drawn off the pin at a second viscosity higher than the first velocity.

45 Claims, 2 Drawing Sheets

METHOD OF PRODUCING A YARN AND AN APPARATUS FOR CARRYING OUT THIS METHOD

The present application is a continuation application of U.S. patent application No. 07/206,528 filed June 14, 1988, and now abandoned.

The present invention concerns a method of producing a yarn and an apparatus for carrying out this method.

Synthetic which are also called chemical fibers are not ready for further processing immediately after the primary spinning. In order to produce the essential textile characteristics as for instance elasticity, elongation, low shrinking etc., the chemical fibers have to be drawn after the primary spinning. By the drawing process the macromolecules which are oriented randomly after the primary spinning are aligned in the longitudinal direction of the fibers so that they form a macrostructure corresponding to the structure of natural fibers. The fibers drawn in such a manner are then brought on the market as textile fibers.

In addition to the above-described completely drawn fibers, fibers are known which have been only partially drawn by the manufacture of the chemical fibers and which are known as pre-drawn or pre-oriented yarns or POY yarns. In the following specification these yarns or fibers are specified as "pre-oriented fibers" in a unitary manner. These pre-oriented fibers supplied by the manufacturer of the chemical fibers are then once again drawn by the receiver prior to the further processing in order to produce the above described textile characteristics.

Furthermore, pre-oriented fibers are obtainable which have to be also drawn prior to further processing. These pre-oriented multifilament yarn destined for the manufacture of high-tenacity yarns have a higher degree of polymerisation with respect to the above described pre-oriented fibers and thus an about 10–20% higher solution viscosity measured according to SNV standard 195 590 or 195 591.

In order to enable such a drawing prior to further processing of the fibers, the above-mentioned pre-oriented fibers are supplied over a first delivering works driven by a first velocity to a pin. The fibers are turned round the pin about a certain angle, for instance between 270° and 360°, preferable 360°, and are drawn off by means of a second delivering works which conveys the fibers with a second velocity. For this, a pin heated to a temperature of 140° C. up to 200° C. is used, said pin having a diameter between about 40 mm and about 80 mm. Normally, the fibers are drawn with a drawing degree of about 1:1,5 to 1:1,7. The drawing degree is defined as the ratio between the first velocity (the velocity of the first delivering works) and the second velocity (the velocity of the second delivering works).

As already mentioned above, the textile characteristics of the fiber material are substantially determined by such a drawing process. The tenacity of the fibers increases with increasing drawing degree. However, the known method which uses a heated pin has limits with regard to the drawing degree since, depending on the respective fiber, undesired fractures of single filaments (capillary fractures) appear at a drawing degree of between about 1:1,7 and 1:1,9.

It is the object of the present invention to provide a method of the cited kind with which yarns with an especially high tenacity can be manufactured.

The inventive method is based on the idea to use a non-heated pin instead of the above-described heated pin according to the prior art. The above-described pre-oriented fibers (normal POY yarns, POY yarns with a higher degree of polymerisation) which are normally present as multifilament yarns and are used in the method are turned round the non-heated pin for about 270° up to about 360°, preferably about 360°. According to the inventive method the non-heated pin has a diameter which is smaller than 10 mm. The above-described fibers are heated to a temperature of between about 100° C. and about 250° C. for 0,01 sec up to 10 sec immediately after turning round the pin.

The above-described inventive method has a number of advantages.

It could be observed that, at the same drawing degree, yarns processed according to the inventive method have a specific tenacity which is up to 25% higher than the tenacity of yarns which are processed according to the above-described known method. The specific tenacity is defined as force per titre (cN/Tex). Furthermore, the yarns manufactured according to the inventive method have a free thermal shrinking degree which is up to 40% lower than the degree of yarns processed according to the conventional method. This brings along the result that the final products made from the inventive yarns, for instance sewing yarns, warp yarns, weft yarns or woven and knitted planar formations, have an excellent dimensional stability during thermal or hydrothermal treatments in the further processing, for instance dyeing, printing, steaming or in the garment industry or the final use, for instance washing or ironing.

Additionally, the inventive method has a further important advantage. So by using the inventive method it is possible to make use of especially high drawing degrees which cannot be used in the conventional method on account of the appearance of fiber fractures (capillary fractures). So, for instance in the conventional method these capillary fractures, depending on the respective starting material, appear already at a drawing degree of about 1:1,8 up to maximum 1:2,0. In contrast to this, the same starting materials can be drawn up to a drawing degree of 1:2,3 up to 1:2,7 with the inventive method before the first capillary fractures appear. This has the result that the specific tenacity of yarns processed in the inventive manner is between about 35% and about 50% higher compared with conventionally manufactured yarns, as this is demonstrated by the following examples. By this, it becomes possible to manufacture high-tenacity yarns from starting materials with normal tenacity by using the inventive method so that it can be desisted from the use of starting materials having a correspondingly high tenacity which are expensive. In addition to these advantages with regard to the aspect of the costs the inventive method offers completely new technological areas as this is explained in the following with the example of sewing yarns.

The above-described advantages which can be attained by using the inventive method are attributed to the fact that with the inventive method the drawing point is located between the non-heated pin and the heated area which brings along a better and higher orientation of the macromolecules in the fibers of the yarn. By this, the higher specific tenacity and the lower tendency for shrinking of the fibers manufactured in this way is explainable.

In the inventive method the temperature, the dwelling time and the drawing degree depend on the respective starting material. As already mentioned above, as starting material any synthetic pre-oriented fiber (monofilament or multifilament) can serve. A multifilament yarn is preferred. Especially suited are polyester fibers or polyamide fibers. Especially good results with regard to the specific tenacity (strength) and a low thermal shrinking can be attained with the inventive method if dwelling times between about 0,05 sec and about 1 sec and temperatures of between about 180° C. and about 240° C. are selected wherein these dwelling times and temperatures depend on the kind of heating. Preferably, according to the inventive method the used starting material is heated by direct contact with heated heating means after turning round the pin. As heating means the known contact heating means, as for instance a heating drum or especially a heating plate designated as hot-plate, can be used. Furthermore, it is possible to heat the fiber or the multifilament yarn to the above-cited temperatures by indirect heating, for instance by means of correspondingly formed heat tubes. Furthermore, the heating of the fiber or the multifilament yarn can be carried out by radiation. For this, IR-radiators or preferably laser, especially gas laser as for instance $CO_2$-laser or CO-laser can be used.

If according to the inventive method the fiber or the multifilament yarn is heated through a direct contact with the heating means, one adjusts preferably the temperature of the heating means to a value of between about 180° C. and about 240° C. Depending on the respective heating time which is preferably between about 0,05 sec and about 1 sec, the processed material is heated to a temperature of between 140° C. (with short contact times) and about 220° C. (with the above-cited longer contact times). Such a relative high temperature of the material is not abnormal in spite of the above-cited relatively short contact times since it could be ascertained on account of measurements that the material is heated to a temperature range of between about 35° C. and about 75° C., normally to about 50° C., when it is turned round the pin on account of the friction appearing between the pin and the material. If such a heating effect is not desired with certain starting materials, a further embodiment of the inventive method proposes to cool the pin by means of a suitable fluid. By this it is secured in an especially good manner that no non-controlled, continuously increasing heating of the material appears, even with longer use of the inventive method, which may bring along undesired variations in the fiber structure and thus in the characteristics of the material.

In the simplest case the above-described cooling is realized by blowing continuously an air stream onto the pin and the material turned round the same. It is also possible to provide cooling means for the pin which is continuously cooled by a suitable cooling fluid, for instance water or freon, flowing within the same.

In order to secure especially low values of thermal shrinking of the processed material with the inventive method, the material is preferably cooled with a predetermined length after heating. Depending on the respective material the length is determined such that the material can freely shrink during the cooling process to a temperature of about 40° C. up to about 60° C. However, it is also possible to apply a predetermined stress to the fiber yarn or multifilament yarn in the cooling phase.

Depending on the further processing of the fiber or multifilament yarn made by the inventive method the same can be wound up under tension, without tension or with advance. If the material is dyed subsequent to its manufacture, it is recommended to wind up without tension on corresponding sleeves used for dyeing so that the material can still shrink during dyeing. The fibers or multifilament yarns dyed in such a manner have then a once again reduced boiling shrinkage or thermal shrinkage at 180° C.

As already mentioned, according to the inventive method the drawing degree (first velocity:second velocity) can be the same as with the known method, i.e. depending on the respective material between about 1:1,3 up to about 1:1,9. Especially high capacities (strengths) are attained if one selects with the inventive method a drawing degree of more than 1:2,0, especially a drawing degree of between 1:2,1 and 1:2,7 since with these relatively high drawing degrees an additional increase of the specific tenacity (force per titre, cN/Tex) can be observed. The above-cited drawing degrees relate to multifilament yarns of pre-oriented fibers (POY yarns) which have a number of elementary threads of between about 20 and about 500, preferably of between about 30 and about 150, which is customary for textile purposes. Furthermore, they have a customary titre of between about 100 dtex and about 1000 dtex, preferably of between about 100 dtex and about 600 dtex.

In general, it has to be stated that with the inventive method the drawing degree is normally between about 5% and about 50%, preferably between about 20% and about 40%, above the drawing degree which is recommended by the manufacture of the respective material. As upper limit of the drawing degree a value has to be considered which is between about 5% and about 25% below the drawing degree which brings along a fracture of the multifilament yarn or of the fiber. If one takes into account the above-cited general lower and upper limit of the drawing degree, by the inventive method fibers or yarns can be manufactured which have a significantly increased specific tenacity (strength) and a significantly reduced free thermal shrinkage or boiling shrinkage compared with conventionally manufactured fibers or yarns. By variation of the drawing degree the specific tenacity, the thermal shrinkage and the boiling shrinkage can be adapted to the respective requirements.

Preferably, with the inventive method a pre-oriented fiber is used as starting material. This fiber is processed not only as single fiber but also as multifilament yarn in accordance with the statements of above.

Another embodiment of the inventive method proposes to use a pre-oriented multifilament yarn with higher polymerization degree as starting material. With regard to the parameter of this method the statements of above come true. With such a starting material the specific tenacity is once again significantly improved and the thermal shrinkage at 180° C. or the boiling shrinkage is further reduced compared with a material which has been processed conventionally.

On principle, with the inventive method all the thermoplastic chemical fibers can be used. Especially good results are attained with polyester fibers or polyamide fibers.

According to another embodiment of the inventive method the multifilament yarn processed according to the above-described steps is provided with a twist prior to its winding up. This twist is between about 5 twists/m and about 400 twists/m, preferably between about 8 twists/m and about 30 twists/m.

Thereafter, the twisted multifilament yarn is wound up and can be further processed optionally which can be done for instance by texturing, twisting, dyeing, aviving and/or weaving.

According to an especially preferred embodiment of the inventive method the multifilament yarn is subsequently swirled (intermingled) with a second yarn (effect yarn) in a fluid stream with the formation of a core-jacket-yarn provided with loops and slings. The swirling is carried out such that the multifilament yarn forms the interior core and the second yarn (effect yarn) forms the jacket wrapping the core. Such a swirling is carried out in nozzle means which are known per se. The special advantage of the yarn manufactured according to the above-described method with regard to a corresponding yarn manufactured according to the prior art resides in the fact that the inventive core-jacket-yarn has not only a higher tenacity (strength) and a lower thermal shrinkage and boiling shrinkage but also a uniform tone-in-tone colouring. As with the conventionally made core-jacket-yarn the core yarn does not get a darker, lighter or other toning compared with the wrapping jacket yarn (effect yarn) which both consist of the same material. Both yarn components (core and effect component) rather have the same colour toning and the same colour depth. This is even true if the titre of the single filaments of the core yarn is substantially larger or smaller than the titre of the single filaments of the effect yarn, for instance about a factor of between 1,5 and 4.

The above-described improvement of the dye affinity of the yarn made according to the inventive method is attributed to the fact that the dye affinity of the core material can be adapted to the dye affinity of the effect material by the use of a non-heated pin with the above-cited diameter, by the immediately following thermal treatment which can be varied in its temperature and in its dwelling time within the above-cited values, and by the above-described conditions during cooling according to which the tension or stress can be varied.

Normally, according to the inventive method the multifilament yarn forming the core and the effect yarn forming the jacket are swirled with an advance. Preferably, for the multifilament yarn an advance is selected which is between about 1% and about 7%. For the effect yarn the advance values are about 15% and about 45%.

In order to attain an especially high swirling effect, i.e. a high number of loops or slings crossing themselves, according to a further embodiment of the inventive method the core material is wetted with water or with an aqueous dispersion prior to swirling. The water or the aqueous dispersion brings along the effect that the friction between the single filaments is reduced. Furthermore, the addition of water intensifies the swirling which can be especially observed when an aqueous dispersion is used. As aqueous dispersions such can be used which have grain-like particles the specific weight thereof being larger than 1 g/cm$^3$. The concentration of the grain-like particles in such a dispersion is between about 5 g/l and about 150 g/l, preferably between about 30 g/l and about 60 g/l. The diameters of the grain-like particles vary between about 4 mm and about 400 mm, especially between about 20 mm and about 100 mm. The mohs hardness of the particles is between 1 and 6,5, preferably between 3 and 5. As grain-like particles especially talc, diatomite, alumina, titanium dioxide and/or barium sulphate can be used. It is also possible to use a suspension in the above-cited concentration and composition instead of the dispersion.

Normally, according to the inventive method a multifilament yarn is used as effect yarn having about half of the elementary threads of the core yarn. So a typical core material has about 40 and about 500 elementary threads, preferably between about 50 and about 150.

The titre of the effect yarn is normally about 15% up to about 40% of the titre of the core yarn. Customarily, core yarns with a titre of between about 100 dtex and about 1000 dtex, preferably of between about 100 dtex and about 600 dtex, are used.

A dye affinity especially uniform with regard to the colour toning and the colour depth can be attained according to a further embodiment of the inventive method by also turning the effect yarn round a non-heated pin with a diameter smaller than 10 mm about an angle of between 270° and 360°, preferably 360°, prior to swirling and subsequently heating the effect yarn to a temperature of between 100° C. and 250° C., especially of between 180° C. and 240° C., for 0,01 sec to 10 sec, especially for 0,05 sec to 1 sec, immediately after turning round the same. By this, the effect yarn is adapted in its processing to the processing of the core yarn prior to the swirling. This is especially true if one draws the effect yarn and the core yarn with the same drawing degree which is in the above-cited range according to the inventive method. It is especially advantageous with regard to the dyeing affinity of the effect yarn if one adapts the cooling conditions with regard to the tension or stress during cooling to the cooling conditions of the core yarn.

The statements above concern a method according to which an effect yarn is swirled with a core yarn. Of course, it is also possible with the inventive method to swirl a plurality of core yarns with one effect yarn or to swirl a plurality of effect yarns with one core yarn. Preferably, one to four core yarns are swirled with one to four effect yarns.

It is also possible to twist the core yarn and effect yarn according to a conventional method instead of swirling the same with one another.

In order to further improve the compound of the single filaments of the swirled yarns, according to another embodiment of the inventive method the yarns are provided with a twist of between about 100 twists/m and about 400 twists/m, preferably of between about 150 twists/m and about 300 twists/m, after the swirling. However, if a very voluminous yarn is desired, the yarn made according to the inventive method can also be provided with essentially less twists, for instance with a protection twist of between about 2 twists/m and about 20 twists/m.

When the yarn made by the inventive method is preferably wound up without tension or with advance, it can shrink during a subsequent hydrothermal treatment, for instance during dyeing. This brings along the result that the slings or loops crossing with one another are reduced in their diameter for about 20% up to about 95%. The degree of reduction substantially depends on the fact whether during the preceding heating of the effect material and during the subsequent cooling stresses have been fixed which bring along a shrinking of the fiber material during the hyrothermal treatment. If with the inventive method a yarn with a relatively low volume is to be made, which is for instance desired when using such a yarn as sewing yarn, the heating of the effect yarn and the following cooling has to be carried out under tension. In this case an especially high shrinkage appears which brings along a corresponding reduction of the diameter of the loops and slings crossing with one another through the hydrothermal treatment, for instance from 60 to 95% related to the original diameter. However, complete drawing tight of the slings or loops in connection with the formation of corresponding knots is not desired with such a yarn which is used as sewing yarn since by this the processing characteristics of such a yarn are deteriorated. So it could be observed that the slings or loops reduced in their diameter have the effect of a very good cohesion which is especially desired on account of the high stresses of a sewing yarn during its processing. Furthermore, such a sewing yarn has still a certain volume so that air is captured within the yarn which is pressed outwardly during the sewing process, especially during turning the yarn round the thread directing members o the needle. This produces a cooling effect at the deflecting members or the needle s that the frequency of thread fractures is significantly reduced in comparison with a yarn of which the slings are drawn tight in a knot-like manner.

According to another embodiment of the inventive method the yarns swirled with one another are subjected to a stress treatment prior to winding up the same. By doing this the self-crossing slings or loops formed during swirling are reduced wherein, depending on the applied stress or tension, the diameter of the slings or loops is reduced by about 20% up to about 95%. This reduction of the diameters of the slings and loops influences the cohesion of the yarn compound and the volume and the characteristics of a yarn made in such a manner. As already mentioned, with increasing reduction of the diameter of the slings or loops the volume of the yarn decreases. Simultaneously the yarn compound is improved so that such a yarn can be processed without any difficulties even without an additional twisting, for instance as warp in the weaving or knitting or especially a sewing yarn. In the same manner as the above-described yarn which was hydrothermally processed, a yarn the slings and loops of which have been reduced by applying a tension has excellent characteristics when it is used as sewing yarn. So it could be observed that a sewing yarn the sling or loop diameter of which was reduced to about 95% by the above-described stress treatment had substantially less thread fractures in sewing tests compared with a sewing yarn of the same starting materials, the slings and loops of which have been drawn tight so that knots were formed. On the one side this is attributed to the fact that a yarn the slings or loops of which were not drawn tight in a knot-like manner includes a substantially larger air volume compared with a yarn the slings and slots of which were drawn tight in a knot-like manner. Furthermore, the yarn made according to the invention has a substantially higher tenacity or strength compared with a conventionally treated yarn on account of its special processing so that the reduced frequency of thread fractures during sewing tests with the inventive yarn can be explained. Also by comparing dyeing tests it could be determined that with the use of the same starting materials with a conventionally made sewing yarn the core material and the effect material were dyed differently not only in the colour depth but also in the colour toning while this was not the case with the sewing yarn made according to the invention.

In order to carry out the above-described stress treatment after the swirling the yarn is fed to the stress treatment with a velocity which is between 0,1% and 5%, especially between 0,1% and 2,5%, less than the velocity with which the yarn is drawn off the stress treatment. These velocity differences are dependent on the one side on the desired reduction of the diameter and on the other side on the respective starting material and the conditions of drawing (drawing degree, temperature, dwelling time and stress during cooling).

According to another embodiment of the inventive method a thermal treatment is carried out prior to winding up the swirled yarns in addition to the stress treatment or instead of the stress treatment wherein the temperature of the thermal treatment varies between about 100° C. and about 250° C., especially between about 180° C. and about 230° C. By this thermal treatment a reduction of the diameter of the self-crossing slings and loops is attained in a similar manner as through the stress treatment which brings along the already described advantages. Furthermore, stresses fixed in the yarn are released so that a yarn processed in such a manner has values of thermal shrinkage or boiling shrinkage which are between about 2% and about 4% related to the original length. By the thermal treatment which is carried out with dwelling times of between about 0.01 sec to about 10 sec, especially of between 0,05 sec and 1 sec, also the dyeing affinity of the core material is further approximated to the dyeing affinity of the effect material. This brings along the result that with such a yarn no different dyeing affinity of core yarn and effect yarn appears even with dyeing with dyes having large molecules and marking the structure differences.

The swirled yarns are preferably fed to the thermal treatment with a velocity which is the same as or which is higher than the velocity with which the yarns are drawn off the thermal treatment. Especially feeding velocities are used which are about 0,1% to 10%, preferably about 2% to 4%, higher than the velocities for drawing off. By this it is attained that the swirled yarns can freely shrink during the thermal treatment so that they do not have any fixed stresses which can later produce an undesired shrinkage.

If according to the above-described method a sewing yarn is to be manufactured, it is recommended to use a pre-oriented multifilament yarn (POY yarn) as starting material for the core component. The core yarn is turned round a non-heated pin about an angle between about 270° and 360°, preferably about 360°. The pin has a diameter which is smaller than 10 mm. Thereafter, the core yarn is heated to a temperature between about 180° C. and about 250° C., preferably by contact heating by means of a hot plate. The drawing of the core yarn is carried out between a first delivering works winding off the core yarn from a spool and a second delivering works located after the hot plate. Depending on the respective starting material the drawing degree is preferably between 1:1,7 and 1:2,7, especially between 1:2,0 and 1:2,3, i.e. as lower limit between about 5% and about 50% over the drawing degree recommended by the manufacturer and as upper limit between about 5% and about 25% below a value at which the yarn breaks.

Thereafter, the core yarn is cooled to a temperature of about 50° C. in a free shrinking manner and then swirled with a second yarn which forms the effect yarn with an advance of between 1% and 7%.

Prior to the swirling, the effect yarn is conventionally pre-drawn by means of a heated pin or preferably processed as above described for the core yarn wherein only the effect yarn is fed to the swirling with an advance of between about 15% and 45%.

After swirling, the core-jacket-yarn having the self-crossing slings or loops is subjected to a stress treatment. Depending on the desired reduction of the diameter of the slings or loops, the swirled yarn is fed to the stress treatment with a first velocity which is between about 2% and about 5% lower than the velocity with which the yarn is drawn off the stress treatment. Hereafter follows a thermal treatment at a temperature of between about 180° C. and 240° C. during about 0,5 sec and about 2,5 sec. The feeding velocity to the thermal treatment is about 2% up to about 5% higher than the discharge velocity from the thermal treatment. Hereafter the yarn is cooled to a temperature between about 60° C. and about 40° C. with constant length. Subsequently, the yarn is wound up in a stress-lean manner and, if necessary, still provided with a twist of between 100 twists/m and 600 twists/m prior to and/or during the winding process.

The sewing yarn manufactured in such a manner is dyed and thereafter avived according to the customary methods. A further reduction of the diameter of the slings or loops can appear on account of the hydrothermal treatment during dyeing depending on the stress during the stress treatment after swirling, the temperature and the stress of the thermal treatment and the stress during cooling. However, it has to be prevented that the sewing yarn still shrinks so far that the slings or loops draw tight in a knot-like manner.

In the preceding text it is indicated that the diameters of the self-crossing loops and slings are reduced to a value of between about 20% and about 95% of the original diameters on account of the stress treatment, the thermal treatment, the cooling after the thermal treatment and possibly the hydrothermal treatment. Of course, it cannot be excluded that a few slings and loops draw tight in a knot-like manner. However, the portion of the slings or loops drawn tight in a knot-like manner in the final yarn is to be as low as possible, i.e. below 15%, preferably below 5%, related to the complete number of slings and loops.

Furthermore, the invention is directed to an apparatus for carrying out the above-described method.

A first embodiment of the inventive apparatus for carrying out the method comprises a first delivering works for drawing off the fiber or the multifilament yarn preferably from a spool, a pin wrapped by the yarn with an angle of between about 270° and 360°, preferably about 360°, a second delivering works for drawing off the yarn from the pin and winding means. The pin is a non-heated pin and has a diameter of less than 10 mm. Heating means are located between the pin and the second delivering works.

In the above-cited apparatus the heating means is preferably formed as contact heating means, for instance as a hot drum or hot plate. It is also possible to provide IR heating means or a laser, especially a gas laser, preferably a $CO_2$-laser or a CO-laser, as heating means. The last cited heating means cause an especially fast heating of the yarn or of the fiber. The heating means can also consist of a convection heating means, for instance of a heat tube having a length of between about 0,5 m and about 4 m.

In order to cool the yarn or the fiber at a predetermined stress or tension, with a further embodiment of the inventive apparatus a third delivering works is located behind the second delivering works in the running direction of the yarn. This third delivering works is selectively driven by means of a corresponding gear box with the same velocity as the second delivering works or faster or slower than the same.

Another embodiment of the inventive apparatus which is especially suited for the manufacture of a core-jacket-yarn comprises a fourth delivering works which is used for drawing off the second yarn (effect yarn) preferably from a spool. This delivering works is followed in running direction of the second yarn by a second pin which is wrapped by the second yarn with an angle of between about 270° and 360°. Hereafter a fifth delivering works for drawing off the second yarn from the pin follows. The fourth delivering works and the fifth delivering works are connected to a drive motor through a gear box. The gear box includes replacable mating gear pairs by means of which the velocities of the two gear boxes can be adjusted relative to one another. By this, it is attained that the above-indicated drawing degrees can be varied correspondingly. The drive means of the above-described first and second delivering works corresponds to the drive means of the fourth and fifth delivering works. Hereafter follows a nozzle of a known type as for instance that offered by Dupont with the type name XV. The multifilament yarn of the core is swirled with the second yarn by means of this nozzle. After swirling the yarn is wound up with customary winding means.

In another embodiment of the inventive apparatus, means for wetting the core yarn with water or with an aqueous dispersion or suspension is located before the nozzle. This means can for instance be formed as a trough through which the core material is fed by means of corresponding deflecting members. It is also possible to use for this slop padding means as known in the art and as for instance offered by the firm Heberlein with the system name Hema-Wet-Duse.

The above-described second pin can be formed as conventional heat pin (hot pin) with a diameter of between about 40 mm and about 80 mm. It is also possible to provide a pin which is not heated and which has a diameter smaller than 10 mm. In this case, a further embodiment of the inventive apparatus provides second heating means prior to the fifth delivering works. This heating means has a construction comparable with the above-described first heating means.

Furthermore, in this embodiment of the apparatus a sixth delivering works can still be located prior to the nozzle. This delivering works enables cooling of the effect yarn at a predetermined stress. Preferably, this sixth delivering works is connected to the fifth delivering works by means of a corresponding gearing.

A further embodiment of the inventive apparatus which is especially used for the manufacture of sewing yarn includes tensioning means after the nozzle and prior to the winding means, said tensioning means comprising a seventh and an eighth delivering works. Possibly, third heating means and/or cooling means can still be located before the winding means and which enable an application of the swirled yarn with a predetermined tension by means of a corresponding number of delivering works. The third heating means is preferably formed as convection heating means, for instance as a heat tube having a length of between about 0,5 m and about 6 m, or as radiation heating means, for instance as an IR radiator or as a laser, especially as a gas laser, preferably as a $CO_2$-laser or CO-laser.

In order to secure a perfect feeding of the yarn the above-described delivering works consist of godets. Between these godets the necessary number of support rollers and pig-tails is provided so that an exact run of the yarn is guaranteed.

With regard to the material of the first or second pin it has to be stated that if pins with diameters smaller than 10 mm are used these are preferably provided with a coating consisting of ceramics. By this a high smoothness of the surface is attained, and it is simultaneously secured that the pin can be used over a long period of time without any mechanical damage. If pins with inner cooling means are used, the ceramics coating has the effect that there is a good heat conduction to the cooling means. Of course, it is also possible to make the pin completely of ceramics.

Further advantageous embodiments of the inventive method as well as of the inventive apparatus are indicated in the subclaims.

In the following, the inventive apparatus is explained in detail in connection with the drawing and the inventive method is explained in detail in connection with examples.

Figure 1:
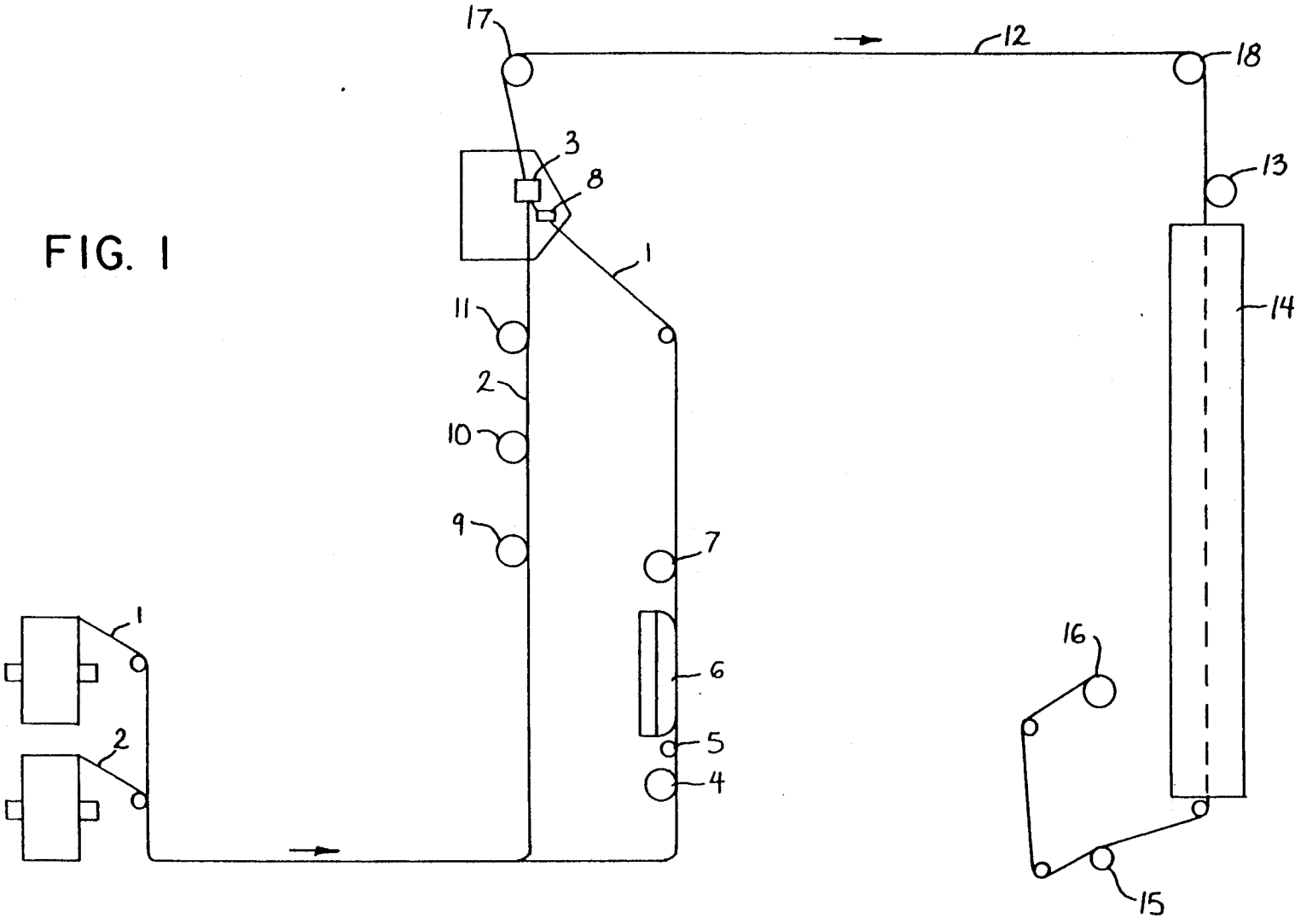
FIG. 1 is a schematic diagram of the apparatus and method of the present invention.

A core yarn 1, for instance a pre-oriented multifilament yarn (POY yarn) having a monofilament titre of 10,23 dtex and a second yarn (effect yarn) 2 which is also a pre-oriented multifilament yarn (with a monofilament titre of 3,46 dtex are supplied from a source in a yarn supply creel on separate paths to a nozzle 3.

At first, the core yarn runs through a drawing zone with a delivering works 4, a non-heated drawing pin 5 which is wrapped by the core yarn 1 with an angle of 360°, a hot plate 6 and a godet 7 and is then fed through means 8 for wetting with water to the nozzle 3 where it is swirled (intermingled) with the effect yarn 2.

The effect yarn 2 has before passed a delivering works 9, a drawing apparatus 10 and a further delivering works 11. In the shown embodiment the drawing apparatus 10 consists of a conventionally formed hot pin having a diameter of 60 mm while the drawing pin 5 has a diameter of 8 mm. As described above, also the effect yarn 2 is turned round the drawing pin 10.

Subsequent to the swirling of the two yarns 1 and 2 in the nozzle 3 the yarn 12 formed in the nozzle havinq self-crossing slings and loops standing off passes a stress treatment zone located between the delivering works 17 and 18 and a heat treating zone. The heat treating zone includes a delivering works 13, heating means 14 and a delivering works 15. In the embodiment of the drawing the heating means 14 is a heat tube and has the customary control means so that a desired temperature in the range of between about 100° C. and about 250° C. can be adjusted. Heating means 14 may employ hot air, as shown in FIG. 1B. Through the stress treatment and the heating means 14 the diameters of the slings and loops are reduced for about 20 up to about 95%. The reduction of the diameter is dependent on the processed material on the one side and on the velocity of the delivering works 13 and 15 relative to one another on the other side as this has been described before. The final yarn is then fed to winding means 16 in the customary manner.

The core yarn 1 which has to be drawn with a drawing degree of 1:1,86 according to the statements of the manufacturer was drawn with a drawing degree of 1:2,3 on the above-described apparatus. The temperature of the hot plate was 250° C.

The effect yarn was drawn with a drawing degree of 1:1,73 and a temperature of the drawing pin of 140° C. according to the statements of the manufacturer.

The core yarn was supplied to the nozzle with an advance of 4% while the effect yarn was supplied to the nozzle with an advance of 20%.

The temperature of the heating means 14 was adjusted to a value of 230° C. The velocities of the delivering works were selected such that the velocity at the winding means 16 was 500 m/min.

The specific tenacity or strength of the core yarn 1 before the nozzle was measured. It had a value of 60 cN/tex. Compared with this the above-described apparatus was modified such that the drawing pin 5 was replaced by a conventional, heated drawing pin which was heated to a temperature of 140° C. Simultaneously the hot plate 6 was removed. The above-described method was carried out on this modified apparatus with the same core yarn and the same effect yarn. The core yarn was drawn with a drawing degree of 1:1,86 according to the statement of the manufacturer.

Core yarn was removed before the nozzle 3, and the tenacity of the core yarn was measured. The core yarn having a drawing degree of 1:1,86 had a specific tenacity of 40 cN/tex.

In a further test on the modified apparatus including the conventionally formed drawing pin with a diameter of 60 mm which was heated to a temperature of 140° C., it was attempted to treat the core yarn 1 with a drawing degree of 1:2. It could be observed that the core yarn 1 had a plurality of capillary fractures before the nozzle 3 so that this test had to be stopped.

A further test was carried out with a drawing degree of 1:1,925. Here, the core yarn made by use of the conventional drawing pin had a slightly improved specific tenacity of 41 cN/tex.

The core yarns which were pre-drawn in a different manner were swirled with the same effect yarn, as described above, subsequently subjected to a heat treatment and thereafter wound up. With sewing yarn no. 1 that yarn was designated the core yarn which had a specific tenacity of 60 cN/tex. With sewing yarn no. 2 that yarn was designated the core yarn which had a specific tenacity of 40 cN/tex, and with sewing yarn no. 3 that yarn was designated the core yarn which had a specific tenacity of 41 cN/tex.

A sewing yarn no. 4 the core yarn which had a specific tenacity of 40 cN/tex and which was made of the same starting materials and which had the same titre as the sewing yarn 1 to 3 was used as comparison yarn in the following industrial sewing tests. The sewing yarn 4 did not have diminished slings or loops in contrast to the sewing yarn 1 to 3 but slings and loops drawn tight in a knot-like manner.

The results of the industrial sewing tests showed that sewing yarn 1 had the lowest frequency of thread fractures during forward sewing, backward sewing and multidirectional sewing at stitch numbers of between 4000 and 6000 stitches per minute. Sewing yarn no. 3 had a frequency of thread fractures which was about 30% higher while sewing yarn no. 2 had a frequency of thread fractures which was within the error tolerance with sewing yarn no. 3. Sewing yarn no. 4 was significantly worse and had a frequency of thread fractures which was 45% higher than that of sewing yarn no. 1.

Figure 2:
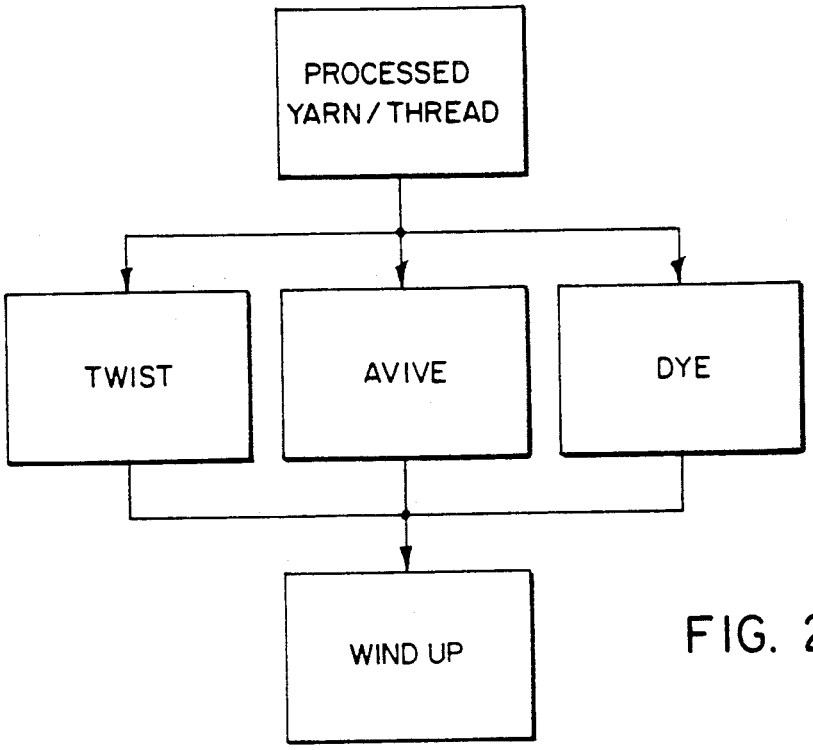
FIG. 2 is a fragmentary, schematic diagram showing additional aspects of the method and apparatus of the present invention.

Thereafter, the sewing yarns 1 to 4 were wound up on a dyeing spool and were dyed in a bath having several dye combinations, as shown in FIG. 2. Since all the sewing yarns consisted of polyester the dyeing step was carried out at 130° C. For the dyeing process the following temperature gradient was selected:

start temperature: 70° C.
heating temperature to 130° C. with 2° C./min
dwelling time at 130° C.: 45 min
cooling to 80° C. with 2° C./min.

After dyeing the material was cold and hot rinsed twice and thereafter conventionally dried. The dye baths were each adjusted to a pH of 4,5 by the addition of acetic acid and sodium acetate. Furthermore, the baths had 0,5 g/l of a dispersant/levelling agent (Lewegal HTN of Bayer). The following dye combinations were used:

| | |
|---|---|
| | dye combination I: |
| 0,5% | Resolin yellow-brown 3 GL, 200% (C. J. Disperse orange 29) |
| 0,25% | Resolin red FB, 200% (C. J. Disperse red 60) |
| 1% | Resolin navy blue 2 GLS, 200% |
| | dye combination II: |
| 3% | Resolin navy blue 2 GL5, 200% (C. J. Disperse blue 79) |
| 0,15% | Resolin yellow 5 GL, 200% |
| 0,8% | Resolin red BBL, 200% |
| | dye combination III: |
| 0,5% | Resolin blue BBLS, 200% (C. J. Disperse blue 165) |
| 1,5% | Resolin yellow-brown 3 GL, 200% (C. J. Disperse orange 29) |
| 0,5% | Resolin red FB, 200% (C. J. Disperse red 60) |

The visual and colorimetric evaluation of the four sewing yarns showed that only the pin winding of sewing yarn 1 gave a uniform colour impression with regard to the colour toning and to the colour depth. The colours of the sewing yarns 2 to 4 were not uniform and were spotted. The core material differently dyed with regard to colour toning and colour depth could be clearly distinguished.

Further materials were treated in order to get comparison results. For this, at first as starting material a polyester multifilament yarn having a starting titre of 285 dtex and an elementary thread number of 32 was used. This material designated starting material 2 was turned round a pin heated to 140° C. for an angle of 360° and drawn with variation of the drawing degree. The results of the specific tenacities and of the free thermal shrinkage at 180° C. in response to the selected drawing degree can be taken from the following table.

TABLE 1

| drawing degree | specific tenacity (cN/tex) | thermal shrinkage (180° C.) |
|---|---|---|
| 1:1,700 | 37,24 | 10,1 |
| 1:1,800 | 39,08 | 10,9 |
| 1:1,900 | 43,05 | 11,88 |
| 1:2,000 | 48 | 12,3 |

The same starting material 2 was turned round a non-heated pin with a diameter of 8 mm for an angle of 360° and was thereafter passed over a hot plate heated to 240° C. and drawn with different drawing degrees. The results of this test can be taken from the following table.

TABLE 2

| drawing degree | specific tenacity (cN/tex) | thermal shrinkage (180° C.) |
|---|---|---|
| 1:1,750 | 41,06 | 6,29 |
| 1:1,800 | 42,61 | 6,29 |
| 1:1,850 | 45,26 | 6,09 |
| 1:1,900 | 49,22 | 5,88 |
| 1:1,950 | 50,06 | 6,06 |
| 1:2,000 | 52,28 | 6,09 |
| 1:2,050 | 55,93 | 6,29 |
| 1:2,100 | 57,69 | 6,29 |
| 1:2,125 | 59,99 | 6,29 |
| 1:2,150 | 61,03 | 6,09 |
| 1:2,175 | 62,85 | 6,09 |
| 1:2,200 | 63,20 | 6,29 |
| 1:2,225 | 64,90 | 6,29 |
| 1:2,250 | 63,97 | 6,10 |
| 1:2,275 | 67,00 | 6,10 |
| 1:2,300 | 67,12 | 6,10 |

As can be taken from a comparison of these two tables, the material which was treated by means of the non-heated drawing pin in connection with the following hot plate had significantly higher specific tenacity values and a significantly reduced thermal shrinkage. Especially the specific tenacities which appear at drawing degrees higher than 1:2 cannot be reached with the material which was only treated with the heated drawing pin since here capillary cracks already occurred at a drawing degree of 1:1,9 to 1:1,95. Accordingly, a tenacity of 48 cN/tex which was reached with a drawing degree of 1:2 with the first material is not suited for production. Thus, a maximum specific tenacity of 43,05 cN/tex can be reached for starting material 2 with the method according to which it is drawn with a heated pin.

The values in the second table look differently. The material drawn by means of the non-heated pin in connection with the hot plate has a maximum specific tenacity of 67 cN/tex since the first capillary fractures were observed at a drawing degree of 1:2,325. A larger batch of several tons of yarn was made in a test under production conditions at a drawing degree of 1:2,3. Here, no capillary fractures could be recognized. The drawing degree indicated by the manufacturer for the starting material 2 was 1:1,8 to 1:1,85. The starting material 2 was commercial POY polyester yarn.

A further starting material 1 was differently drawn with regard to starting material 2. Starting material 1 which was also a polyester multifilament yarn had a starting titre of 410 dtex and an elementary thread number of 40. Deviating from the tests with regard to starting material 2 starting material 1 was only drawn over the pin heated to 140° C. and having a diameter of 60 mm with a drawing degree of 1:1,85. The drawing degree of 1:1,85 corresponded to the recommendation of the manufacturer for this material. The yarn processed in such a manner had the following specific tenacity and the following thermal shrinkage:

TABLE 3

| drawing degree | specific tenacity (cN/tex) | thermal shrinkage (180° C.) |
|---|---|---|
| 1:1,850 | 34,8 | 10 |

It was further attempted to raise the drawing degree with the above-cited material. However, it could be determined that the first capillary fractures could be observed already at a drawing degree of 1:1,95 while the capillary fractures accumulated at a drawing degree of 1:2,075 such that such a drawn yarn was not suited for use.

Figure 1A:
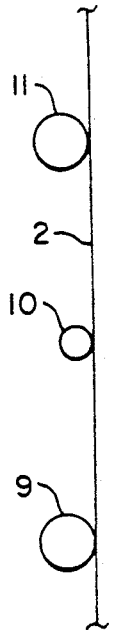
FIG. 1A is a fragmentary, schematic diagram showing a modification of the subject matter of FIG. 1 using a non-heated pin of 10 mm. or less and an associated heating means for the jacket yarn of a sewing thread.
Figure 1B:
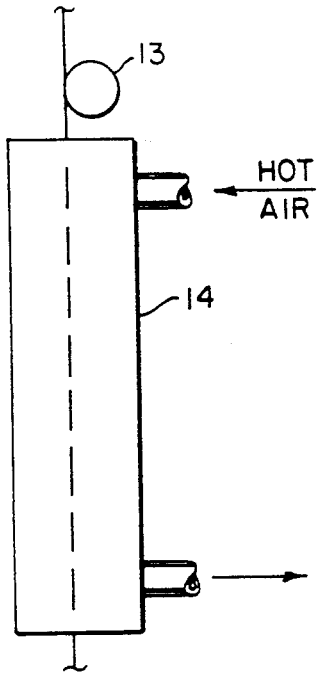
FIG. 1B is a fragmentary, schematic diagram showing a further modification of the subject matter of FIG. 1 showing use of hot air to heat the thread.
Figure 1C:
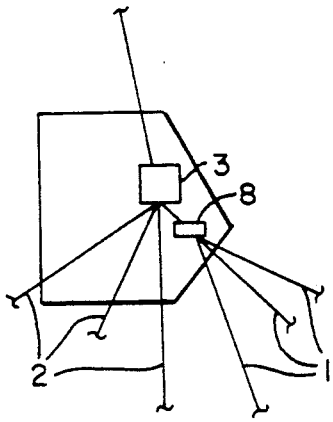
FIG. 1C is a fragmentary, schematic diagram showing an additional modification of the subject matter of FIG. 1 employing multiple core-jacket threads.

In comparison to this the starting material 1 was drawn over a non-heated pin with a diameter of 8 mm and a subsequent heating to 240° C. by means of a hot plate with variation of the drawing degree, as shown in FIG. 1A. Herewith the following specific tenacities and values of thermal shrinkage could be attained:

TABLE 4

| drawing degree | specific tenacity (cN/tex) | thermal shrinkage (180° C.) |
|---|---|---|
| 1:1,850 | 38,23 | 6,68 |
| 1:1,950 | 42,19 | 6,88 |
| 1:2,050 | 51,15 | 6,68 |
| 1:2,150 | 56,81 | 6,90 |
| 1:2,200 | 58,87 | 6,88 |
| 1:2,250 | 61,47 | 7,09 |
| 1:2,300 | 64,02 | 6,88 |
| 1:2,350 | 66,40 | 6,88 |
| 1:2,375 | 67,12 | 6,90 |
| 1:2,400 | 68,44 | 6,88 |
| 1:2,425 | 69,23 | 6,88 |
| 1:2,450 | 68,81 | 6,68 |
| 1:2,500 | 71,74 | 6,68 |
| 1:2,500 | 70,92 | 6,69 |

The first capillary fractures occurred only at a drawing degree of more than 1:2,475. A larger batch of the starting material 1 was manufactured under production conditions with a drawing degree of 1:2,4. No capillary fractures occurred.

We claim:

1. A method of producing a multifilament yarn having increased tenacity and reduced thermal shrinkage properties, said method comprising the steps of:

feeding a synthetic, pre-oriented multifilament yarn having a titer of between about 100 dtex and about 1000 dtex at a first velocity to a non-heated pin, said pin having a diameter of less than 10 mm.;

turning the multifilament yarn around the pin through an angle of between about 270° and 360°;

heating the multifilament yarn immediately after turning around the pin to a temperature of between 100° C. and 250° C. over a period of from 0.01 seconds to 10 seconds;

drawing the multifilament yarn from the pin with a second velocity which is higher than the first velocity;

correlating the first and second velocities with respect to each other such that the drawing ratio applied to the yarn downstream of the pin is equal to, or greater than, a normal drawing ratio specified for the material of the yarn; and thereafter winding up the multifilament yarn.

2. The method according to claim 1 wherein the yarn is turned around the pin through an angle of 360°.

3. The method according to claim 1 wherein the yarn is heated to a temperature between 180° C. and 240° C. for a period of from 0.05 seconds up to 1 second.

4. The method according to claim 1 wherein the yarn is heated by contact with a heated means.

5. The method according to claim 4 wherein the yarn is heated by contact with a means heated to between 180° C. and 240° C.

6. The method according to claim 1 further including the step of cooling the multifilament yarn while allowing the yarn to freely shrink, said cooling occurring after the heating of the yarn.

7. The method according to claim 1 further defined as drawing off the yarn with a second velocity such that the drawing ratio applied to the yarn is greater than 1:2.0.

8. The method according to claim 7 further defined as drawing off the yarn with a second velocity such that the drawing ratio applied to the yarn is between 1:2.1 and 1:2.7.

9. The method according to claim 1 further including the step of applying a twist of between 5 and 400 twists/m. to the yarn prior to winding same up.

10. The method according to claim 1 further defined as feeding a yarn having a titer between about 100 dtex and 600 dtex.

11. The method according to claim 1 further defined as feeding a highly polymerized yarn having a solution viscosity of about 10–20% higher than the solution viscosity of a pre-oriented yarn of normal polymerization.

12. The method according to claim 1 further defined as feeding a yarn having a number of elementary strands of between 20 and 500.

13. The method according to claim 1 further defined as feeding a multifilament yarn comprising polyester or polyamide.

14. A yarn produced by the method of claim 1.

15. A method of producing a core yarn - jacket yarn sewing thread comprising the steps of:

feeding a synthetic, pre-oriented multifilament core yarn having a titer of between about 100 dtex and about 1000 dtex at a first velocity to a non-heated pin, said pin having a diameter of less than 10 mm.;

turning the core yarn around the pin through an angle of between about 270° and 360°;

heating the core yarn immediately after turning around the pin to a temperature of between 100° C. and 250° C. over a period of from 0.01 seconds to 10 seconds;

drawing the core yarn from the pin with a second velocity which is higher than the first velocity;

correlating the first and second velocities with respect to each other such that the drawing ratio applied to the core yarn downstream of the pin is equal to, or greater than, a normal drawing ratio specified for the material of the yarn;

intermingling the core yarn with an effect yarn in a fluid stream to form a core yarn-jacket yarn thread having loops;

reducing the diameters of the loops to a value of between about 20% and about 95% of the diameters of the loops following intermingling; and thereafter winding up the core yarn - jacket yarn thread.

16. The method according to claim 15 further defined as feeding the core yarn to the intermingling with an advance of between 1% and 7% and feeding the effect yarn to the intermingling with an advance of between 15% and 45%.

17. The method according to claim 15 further defined as wetting the core yarn prior to intermingling with the effect yarn.

18. The method according to claim 15 further defined as intermingling the core yarn with a pre-oriented multifilament effect yarn.

19. The method according to claim 15 further defined as feeding a multifilament core yarn having a plurality of elementary strands, and as intermingling the core yarn with an effect yarn having a plurality of elementary strands, the titer of the effect yarn being about 15% to 40% of the titer of the core yarn and the number of strands of the effect yarn being about 50% of the number of strands of the core yarn.

20. The method according to claim 1 further defined as applying a stress treatment to the yarns to reduce the diameter of the loops.

21. The method according to claim 20 further defined as feeding the yarns to the stress treatment with a velocity which is between 0.1% and 5% less than the velocity with which the yarns are drawn off from the stress treatment.

22. The method according to claim 15 further defined as including the following steps, prior to intermingling, feeding the effect yarn to a non-heated pin, said pin having a diameter of less than 10 mm.;

turning the effect yarn around the pin through an angle of between about 270° and 360°;

heating the effect yarn immediately after turning around the pin to a temperature of between 100° C. and 250° over a period of from 0.01 seconds to 10 seconds;

drawing the effect yarn from the pin with a second velocity which is higher than the first velocity; and correlating the first and second velocities with respect to each other such that the drawing ratio applied to the effect yarn downstream of the pin is equal to, or greater than, a normal drawing ratio specified for the material of the yarn.

23. The method according to claim 20 further defined as drawing off the effect yarn with a second velocity such that the drawing ratio applied to the yarn is between 1:1.3 and 1:2.7.

24. The method according to claim 23 further defined as drawing off the effect yarn with a second velocity such that the drawing ratio applied to the yarn is between 1:1.7 and 1:2.4.

25. The method according to claim 15 further defined as intermingling one to four core yarns with one to four effect yarns.

26. The method according to claim 15 further defined as including the step of heating the intermingled yarns to a temperature of between about 100° C. and about 250° C. prior to winding up same.

27. The method according to claim 26 further defined as heating the intermingled yarns over a period of between 0.01 second and 10 seconds.

28. The method according to claim 26 further defined as heating the intermingled yarns in a stream of hot air.

29. The method according to claim 26 wherein the thread is fed to the heating at the same velocity as it is drawn off from the heating.

30. The method according to claim 26 wherein the thread is fed to the heating at a velocity that is between about 0.1% and 10% higher than the velocity at which it is drawn off from the heating.

31. The method according to claim 26 further defined as including the step of twisting the thread with a twist of between about 10 twists/m. and 800 twists/m.

32. The method according to claim 15 further defined as including the step of carrying out at least one of dying and aviving the thread prior to winding up same.

33. The method according to claim 15 further defined as including the step of twisting the thread with a twist of between 100 twists/m. and 500 twists/m. after intermingling.

34. A yarn produced by the method of claim 15.

35. An apparatus for producing a multifilament yarn having increased tenacity and reduced thermal shrinkage properties, said apparatus comprising:

first delivering means (4) for drawing off a multifilament yarn having a titer of between about 100 dtex and about 1000 dtex with a first velocity;

a pin (5) wound by the yarn supplied by said first delivering means about an angle of between 270° and 360°, said pin being non-heated and having a diameter less than 10 mm.;

second delivering means (7) for drawing off the yarn from the pin with a second velocity;

means for correlating the first and second delivering means with respect to each other such that the drawing ratio applied to the yarn is equal to, or greater than, a normal drawing ratio specified for the material of the yarn;

heating means (6) located between said pin and said second delivering means for heating said yarn, said heating means being closely proximate to said pin for heating the yarn immediately after turning around said pin; and means (16) for winding up the yarn.

36. The apparatus according to claim 35 wherein said heating means (6) comprises a contact heating means.

37. The apparatus according to claim 35 further including additional delivering means downstream of said second delivering means for controlling the tension in the yarn as it cools.

38. The apparatus according to claim 35 further defined as one for producing a core yarn - jacket yarn sewing thread employing said multifilament yarn as the core yarn and further including:

third delivering means (9) for drawing off a second multifilament yarn;

a second pin (10) wound by the second yarn about an angle of between 270° and 360°;

fourth delivering means (11) for drawing off the yarn from the pin; and means (3) for intermingling the core yarn and the second yarn so that the latter forms a jacket having loops for the core yarn and hence the thread, said intermingling means being located upstream from said winding up means.

39. The apparatus according to claim 38 further including means (8) upstream of said intermingling means for wetting the multifilament yarn.

40. The apparatus according to claim 38 further including heating means for said second yarn interposed between said second pin and said fourth delivering means, and wherein said second pin has a diameter of less than 10 mm.

41. The apparatus according to claim 38 further including means for applying stress to said thread upstream of said winding up means.

42. The apparatus according to claim 41 wherein said means for applying stress to the thread comprises delivering means spaced along the thread for applying draw to the thread.

43. The apparatus according to claim 41 wherein said means for applying stress to the thread comprises means (14) for applying a thermal stress to the thread.

44. The apparatus according to claim 38 wherein said pins are made of ceramic material.

45. The apparatus according to claim 35 wherein said pin is made of ceramic material.

* * * * *

UNITED STATES PATENT AND TRADEMARK OFFICE

CERTIFICATE OF CORRECTION

PATENT NO. : 5,083,419

DATED : January 28, 1992

INVENTOR(S) : KARL GREIFENEDER ET AL

It is certified that error appears in the above-identified patent and that said Letters Patent is hereby corrected as shown below:

Claim 20, column 17, line 23, delete "1" and substitute therefor ---15---. Claim 22, column 17, line 39, after "250°" insert ---C.---.

Signed and Sealed this

Twenty-sixth Day of October, 1993

*Attest:*

*Attesting Officer*

BRUCE LEHMAN

*Commissioner of Patents and Trademarks*